US011038311B2

(12) United States Patent
Zhang

(10) Patent No.: US 11,038,311 B2
(45) Date of Patent: Jun. 15, 2021

(54) MULTI-FUNCTIONAL CHARGER

(71) Applicant: SHENZHEN YONGMINSHANGDE TECHNOLOGY DEVEOPMENT CO., LTD., Shenzhen (CN)

(72) Inventor: Deyong Zhang, Shenzhen (CN)

(73) Assignee: SHENZHEN YONGMINSHANGDE TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/215,915

(22) Filed: Dec. 11, 2018

(65) Prior Publication Data

US 2019/0199047 A1 Jun. 27, 2019

(51) Int. Cl.

| | |
|---|---|
| ***H01R 31/06*** | (2006.01) |
| ***H01R 13/631*** | (2006.01) |
| ***H01R 27/00*** | (2006.01) |
| ***H01R 13/627*** | (2006.01) |

(52) U.S. Cl.

CPC ..... *H01R 31/06* (2013.01); *H01R 13/631* (2013.01); *H01R 27/00* (2013.01); *H01R 13/6271* (2013.01)

(58) Field of Classification Search

CPC ..... H01R 27/00; H01R 31/06; H01R 31/065; H01R 13/6675; H01R 13/6271; H01R 13/631

See application file for complete search history.

(56) References Cited

U.S. PATENT DOCUMENTS

| | | | | | |
|---|---|---|---|---|---|
| 5,613,863 | A * | 3/1997 | Klaus | H01R 27/00 | 439/131 |
| 5,684,689 | A * | 11/1997 | Hahn | H01R 13/6675 | 363/146 |
| 5,744,934 | A * | 4/1998 | Wu | H01R 13/6675 | 307/150 |
| 6,126,460 | A * | 10/2000 | Wu | H01R 27/00 | 439/131 |
| 7,241,169 | B1 * | 7/2007 | Yang | H01R 31/06 | 439/172 |
| 7,638,968 | B2 * | 12/2009 | Inoue | H01R 31/06 | 320/107 |
| 7,753,721 | B1 * | 7/2010 | Wu | H01R 13/6275 | 431/131 |
| 8,277,239 | B1 * | 10/2012 | Chan | H01R 31/065 | 439/189 |
| 8,674,558 | B2 * | 3/2014 | De Iuliis | H01R 31/065 | 307/150 |
| 9,166,351 | B1 * | 10/2015 | Wang | H01R 27/00 | |
| 9,537,276 | B1 * | 1/2017 | Cai | H01R 31/06 | |
| 10,297,965 | B1 * | 5/2019 | Yang | H01R 31/06 | |

(Continued)

*Primary Examiner* — Oscar C Jimenez

(74) *Attorney, Agent, or Firm* — Law Offices of Steven W. Weinrieb

(57) ABSTRACT

A multi-functional charger includes an upper housing, a lower housing, a receiving cavity, a PCB, a two-phase mother plug, and a child plug. The receiving cavity is defined between the upper housing and the lower housing. An opening is defined in a side of the upper housing and the lower housing. The PCB is located in the receiving cavity. The multi-functional charger can use conducting member to couple to the PCB, the circuit may be more stability and more safety. It is easy to be assembled, and a various type of child plugs can be coupled to the mother plug. It is also easy to use with good user experience.

8 Claims, 2 Drawing Sheets

(56) References Cited

U.S. PATENT DOCUMENTS

| | | | | |
|---|---|---|---|---|
| 2002/0055288 | A1* | 5/2002 | Philips | H01R 31/065<br>439/170 |
| 2003/0068909 | A1* | 4/2003 | Su | H01R 31/06<br>439/131 |
| 2003/0151938 | A1* | 8/2003 | Liao | H01R 13/6675<br>363/146 |
| 2005/0269987 | A1* | 12/2005 | Lin | H01R 31/065<br>320/115 |
| 2007/0032109 | A1* | 2/2007 | Hung | H01R 13/6675<br>439/172 |
| 2011/0097914 | A1* | 4/2011 | Lee | H01R 29/00<br>439/174 |
| 2013/0323947 | A1* | 12/2013 | Lee | H01R 31/06<br>439/131 |
| 2015/0064955 | A1* | 3/2015 | Liu | H01R 24/68<br>439/344 |
| 2015/0311656 | A1* | 10/2015 | Lai | H01R 31/065<br>439/620.22 |
| 2016/0056649 | A1* | 2/2016 | Chen | H02J 7/0042<br>320/111 |

* cited by examiner

MULTI-FUNCTIONAL CHARGER

FIELD OF THE INVENTION

The present disclosure relates to the field of charging technology, and in particular, it relates to a multi-functional charger.

BACKGROUND OF THE INVENTION

Charger is widely used in modern society. It can save power for providing reliable direct current to electric devices. The charger generally includes a charging plug, a housing, and a printed circuit board. However, the conventional charger may have following problems. First, a power plug is electrically connected to the printed circuit board through wires. It is easy to be open circuited or short circuited, and is inconvenient to be assembled. Second, the charger only has one type of plug, and it may not able to fit other types of plugs. It is inconvenient to use, and has bad user experience.

SUMMARY OF THE INVENTION

The technical problem to be solved by the present invention is to provide a multi-functional charger.

In order to solve the above technical problem, one embodiment of the invention provides the following technical solution:

One embodiment of the invention provides a multi-functional charger. The multi-functional charger includes an upper housing, a lower housing, a receiving cavity, a PCB, a two-phase mother plug, and a child plug. The receiving cavity is defined between the upper housing and the lower housing. An opening is defined in a side of the upper housing and the lower housing. The PCB is located in the receiving cavity. The two-phase mother plug includes a two-phase pin, a plug housing, and a first conducting member. The plug housing is located on the opening. A receiving slot with a cutout is defined in an outer side of the plug housing. A latching block is located on a middle portion of the receiving slot. The latching block is integrally formed with a closed end of the receiving slot and divides the receiving slot into a first receiving slot and a second receiving slot. The two-phase pin is located in the first receiving slot and the second receiving slot respectively. One side of the first conducting member is installed in an inner side of the plug housing, and the other side of the first conducting member is located in the receiving cavity and electrically coupled to the PCB. The child plug includes a plug base, a group of plug pins inserting in the plug base, a second conducting member which is located in the plug base and electrically coupled to the group of plug pins, and a latching component installed in a lower portion of the plug base. The latching component includes a latching member. The latching member is substantially U-shaped. One side of the second conducting member extends into the latching member. The two-phase mother plug is coupled to the child plug in the latching member through the two-phase pin.

As a preferred technical solution of the embodiment of the invention, the child plug is a two-phase child plug or a three-phase child plug.

As a preferred technical solution of the embodiment of the invention, a latching slot is defined in a top surface of the latching block, the latching component comprises an engaging block, the engaging block is formed in a middle portion of the latching member, the child plug is mounted to the two-phase mother plug through engagement of the engaging block and the latching slot.

As a preferred technical solution of the embodiment of the invention, a mounting component is installed on the two-phase pin, and the mounting component comprises two mounting blocks located on two opposite sides and a connecting pole connecting to the two mounting blocks.

As a preferred technical solution of the embodiment of the invention, the plug housing comprises an upper plug housing and a lower plug housing, the first receiving slot, the second receiving slot and the latching block are located on the upper plug housing, a restricting slot is defined in a bottom of the latching block, two installation openings are defined in the first receiving slot and the second receiving slot respectively, the two installation openings are located on two opposite sides of the restricting slot, the two-phase pin is engaged with the two installation openings within the first receiving slot and the second receiving slot, the connecting pole of the two-phase pin is engaged with restricting slot.

As a preferred technical solution of the embodiment of the invention, a positioning hole is defined in the upper plug housing, a positioning pin is located on the lower plug housing, one end of the first conducting member is mounted to the positioning pin, the upper plug housing is engaged with the lower plug housing through engagement of the positioning hole and the positioning pin, and the first conducting member is electrically coupled to the two-phase pin.

As a preferred technical solution of the embodiment of the invention, a plurality of locating blocks is located on a bottom inner portion of the lower housing, and the PCB is mounted on the plurality of locating blocks.

As a preferred technical solution of the embodiment of the invention, a securing block is located on an edge of the upper housing, a groove is defined in an edge of the lower housing, and the upper housing is engaged with the lower housing through engagement of the securing block and the groove.

As a preferred technical solution of the embodiment of the invention, a protrusion is located on an edge of the plug housing, a securing slot is defined in an edge of the opening of the receiving cavity, and the plug housing is engaged in the opening of the receiving cavity through engagement of the protrusion and the securing slot.

As a preferred technical solution of the embodiment of the invention, a plurality of receiving openings is defined in the lower housing, a plurality of USB charging sockets is located on the PCB, each USB charging socket is inserted into each receiving opening correspondingly, and an insert end of each USB charging socket is flush with an outer surface of each receiving opening.

In the embodiment above, the multi-functional charger can use the conducting member to couple to the PCB, the circuit may be more stability and more safety. It is easy to be assembled, and a various type of child plugs can be coupled to the mother plug. It is also easy to use with good user experience.

BRIEF DESCRIPTION OF THE DRAWINGS

The drawings are used for providing further understanding of the present invention, constitute a part of the description and are used for explaining the present invention together with the embodiment of the present invention, but do not constitute a limitation to the present invention. In the drawings:

FIG. 2 is a schematic view of another embodiment of a multi-functional charger.

DETAILED DESCRIPTION OF THE EMBODIMENTS

Figure 1A:
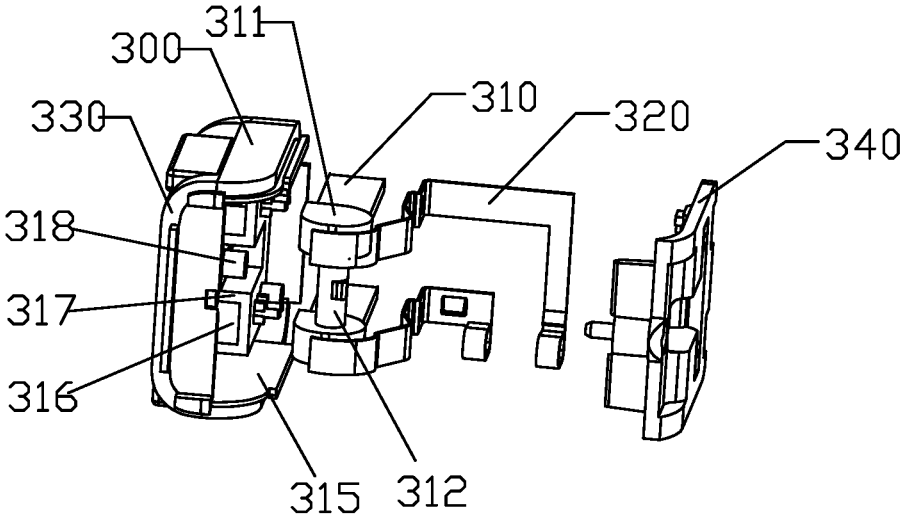
FIG. 1*a* is a first perspective view of a multi-functional charger developed in accordance with the principles and teachings of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

Figure 1B:
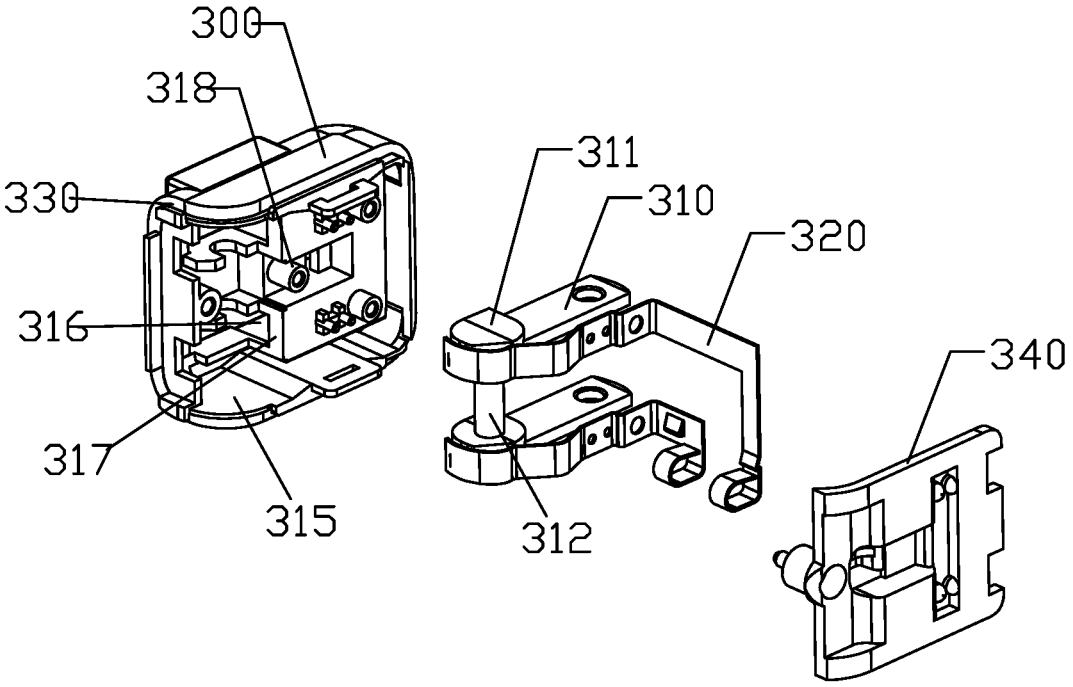
FIG. 1*b* is a second perspective view of the mutli-functional charger disclosed within FIG. 1*a;*
Figure 1C:
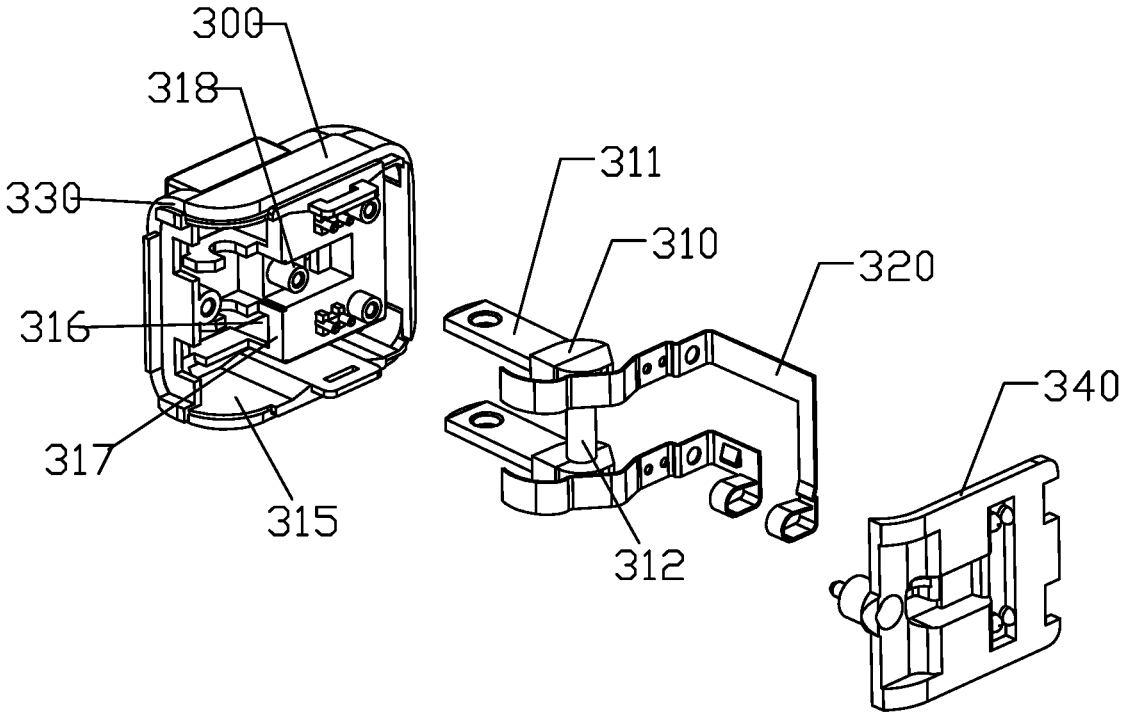
FIG. 1*c* is a perspective view similar to that of FIG. 1*b* showing, however, the connector members of the two-phase disposed at their deployed positions.

As shown in FIG. 1, in one embodiment, a multi-functional charger, includes an upper housing 100, a lower housing 200, a receiving cavity 150 defined between the upper housing 100 and the lower housing 200, a two-phase mother plug 300, a plurality of child plugs 400, and a printed circuit board (PCB) 500. An opening 160 is defined in a side of the upper housing 100 and the lower housing 200.

The two-phase mother plug 300 includes a two-phase pin 310, a plug housing 315, and a first conducting member 320. The plug housing 315 is located on the opening 160. A receiving slot 316 with a cutout 317 defined in an outer side of the plug housing 315. A latching block 318 is located on a middle portion of the receiving slot 316. The latching block 318 is integrally formed with a closed end of the receiving slot 316 and divides the receiving slot 316 into a first receiving slot and a second receiving slot. The two-phase pin 310 is located in the first receiving slot and the second receiving slot respectively. The first conducting member 320 is installed in an inner side of the plug housing 315. One side of the first conducting member 320 is coupled to the two-phase pin 310 in the plug housing 315. The other side of the first conducting member 320 is located in the receiving cavity 150 and is electrically coupled to the PCB 500.

Each child plug 400 includes a plug base 410, a group of plug pins 420 inserting in the plug base 410, a second conducting member 425 which is located in the plug base 410 and is electrically coupled to the group of plug pins 420, and a latching component 430 installed in a lower portion of the plug base 410. The latching component 430 includes a latching member 431. The latching member 431 is substantially U-shaped. One side of the second conducting member 425 extends into the latching member 431. The two-phase mother plug 300 is coupled to the child plug 400 in the latching member through engagement of the two-phase pin 310 and the latching member 431. When the first conducting member is electrically coupled to the PCB, the circuit may be more stability and more safety. It is easy to be assembled, and a various type of child plugs can be coupled to the mother plug. It is also easy to use with good user experience.

In the present embodiment, the child plug 400 is a two-phase child plug or a three-phase child plug.

In the present embodiment, a latching slot is defined in a top surface of the latching block 318. The latching component 430 includes an engaging block 432. The engaging block 432 is formed in a middle portion of the latching member 431. The child plug 400 is mounted to the two-phase mother plug 300 through engagement of the engaging block 432 and the latching slot. Stability of the engagement of the two-phase mother plug 300 and the child plug 400 is enhanced.

In the present embodiment, a mounting component is installed on the two-phase pin 310. The mounting component includes two mounting blocks 311 located on two opposite sides and a connecting pole 312 connecting to the two mounting blocks 311. The plug housing 315 includes an upper plug housing 330 and a lower plug housing 340. The first receiving slot, the second receiving slot and the latching block 318 are located on the upper plug housing 330. A restricting slot is defined in a bottom of the latching block 318. Two installation openings are defined in the first receiving slot and the second receiving slot respectively. The two installation openings are located on two opposite sides of the restricting slot. The two-phase pin is engaged with the two installation openings within the first receiving slot and the second receiving slot. The connecting pole 312 of the two-phase pin 310 is engaged with restricting slot. A positioning hole is defined in the upper plug housing 330. A positioning pin is located on the lower plug housing. One end of the first conducting member 320 is mounted to the positioning pin. The upper plug housing 330 is engaged with the lower plug housing 340 through engagement of the positioning hole and the positioning pin. The first conducting member 320 is electrically coupled to the two-phase pin 310. It has simple structure and is easy to be assembled.

In one embodiment, a plurality of locating blocks is located on a bottom inner portion of the lower housing. The PCB is mounted on the plurality of locating blocks. A securing block 110 is located on an edge of the upper housing 100. A groove 210 is defined in an edge of the lower housing 200. The upper housing 100 is engaged with the lower housing 200 through engagement of the securing block 110 and the groove 210. It has simple structure and is easy to be assembled.

In one embodiment, a protrusion is located on an edge of the plug housing. A securing slot is defined in an edge of the opening of the receiving cavity. The plug housing is engaged in the opening of the receiving cavity through engagement of the protrusion and the securing slot.

In one embodiment, a plurality of receiving openings 220 is defined in the lower housing 200. A plurality of USB charging sockets 510 is located on the PCB 500. Each USB charging socket 510 is inserted into each receiving opening 220 correspondingly. An insert end of each USB charging socket 510 is flush with an outer surface of each receiving opening 220.

As shown in FIG. 2, other types of child plugs 600 can be used to couple to the two-phase mother plug 300.

The multi-functional charger can use conducting member to couple to the PCB, the circuit may be more stability and more safety. It is easy to be assembled, and a various type of child plugs can be coupled to the mother plug. It is also easy to use with good user experience.

The embodiments shown and described above are only examples. Many details are often found in the art such as the other features of a system for generating picture thumbnail. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A multi-functional charger, comprising:

an upper housing;

a lower housing;

a receiving cavity defined between said upper housing and said lower housing, and an opening defined within a side of said upper housing and said lower housing;

a PCB located within said receiving cavity;

a two-phase mother plug, comprising a two-phase pin, a plug housing, and a first conducting member, said plug housing located within said opening, a receiving slot with a cutout defined within an outer side of said plug housing, a latching block located upon a middle portion of said receiving slot, said latching block being integrally formed with a closed end of said receiving slot and dividing said receiving slot into a first receiving slot and a second receiving slot, said two-phase pin being located within said first receiving slot and said second receiving slot respectively, a first side of said first conducting member being installed within an inner side of said plug housing, and a second side of said first conducting member being located in said receiving cavity and electrically coupled to said PCB;

a child plug, comprising a plug base, a group of plug pins inserted within said plug base, a second conducting member which is located within said plug base and electrically coupled to said group of plug pins, and a latching component installed within a lower portion of said plug base, said latching component comprising a latching member, said latching member being substantially U-shaped, and wherein one side of said second conducting member extends into said latching member;

wherein a mounting component is installed upon said two-phase pin, and said mounting component comprises two mounting blocks located upon opposite sides of a connecting pole which connects said two mounting blocks together;

wherein said plug housing comprises an upper plug housing and a lower plug housing, wherein said first receiving slot, said second receiving slot, and said latching block are located upon said upper plug housing, a restricting slot is defined within a bottom portion of said latching block, two installation openings are defined within said first receiving slot and said second receiving slot respectively, said two installation openings are located upon opposite sides of said restricting slot, said two-phase pin is engaged with said two installation openings within said first receiving slot and said second receiving slot, and said connecting pole of said two-phase pin is engaged with said restricting slot; and wherein said two-phase mother plug is coupled to said child plug within said latching member through said two-phase pin.

2. The multi-functional charger as set forth in claim 1 wherein:

said child plug is a two-phase child plug or a three-phase child plug.

3. The multi-functional charger as set forth in claim 1, wherein:

a latching slot is defined within a top surface of said latching block, said latching component comprises an engaging block, said engaging block is formed within a middle portion of said latching member, and said child plug is mounted upon said two-phase mother plug through engagement of said engaging block and said latching slot.

4. The multi-functional charge as set forth in claim 1, wherein:

a positioning hole is defined within said upper plug housing, a positioning pin is located upon said lower plug housing, one end of said first conducting member is mounted upon said positioning pin, said upper plug housing is engaged with said lower plug housing through engagement of said positioning hole and said positioning pin, and said first conducting member is electrically coupled to said two-phase pin.

5. The multi-functional charger as set forth in claim 1, wherein:

a plurality of locating blocks is located upon a bottom inner portion of said lower housing, and said PCB is mounted on said plurality of locating blocks.

6. The multi-functional charger as set forth in claim 1, wherein:

a securing block is located upon an edge portion of said upper housing, a groove is defined within an edge portion of said lower housing, and said upper housing is engaged with said lower housing through engagement of said securing block and said groove.

7. The multi-functional charger as set forth in claim 1, wherein:

a protrusion is located upon an edge portion of said plug housing, a securing slot is defined within an edge portion of said opening of said receiving cavity, and said plug housing is engaged within said opening of said receiving cavity through engagement of said protrusion and said securing slot.

8. The multi-functional charger as set forth in claim 1, wherein:

a plurality of receiving openings is defined within said lower housing, a plurality of USB charging sockets is located upon said PCB, each USB charging socket is inserted into each receiving opening correspondingly, and an insert end of each USB charging socket is flush with an outer surface portion of each receiving opening.

* * * * *